US006929717B2

(12) United States Patent
Azuma et al.

(10) Patent No.: US 6,929,717 B2
(45) Date of Patent: Aug. 16, 2005

(54) PAPER MAKING METHOD AND APPARATUS

(75) Inventors: Takashi Azuma, Shizuoka (JP); Makoto Suzuki, Shizuoka (JP); Nobuhiro Horiuchi, Shizuoka (JP)

(73) Assignee: NSK - Warner Kabushiki Kaisha, Shizuoka (JP)

( * ) Notice: Subject to any disclaimer, the term of this patent is extended or adjusted under 35 U.S.C. 154(b) by 338 days.

(21) Appl. No.: 09/899,601

(22) Filed: Jul. 6, 2001

(65) Prior Publication Data

US 2002/0060019 A1 May 23, 2002

(30) Foreign Application Priority Data

Jul. 6, 2000 (JP) ..... P. 2000-205188
Jul. 6, 2000 (JP) ..... P. 2000-205411

(51) Int. Cl.[7] ..... D21F 13/00
(52) U.S. Cl. ..... 162/218
(58) Field of Search ..... 162/218, 228–229, 162/382, 407, 416, 100; 241/21; 366/101–102, 107, 241

(56) References Cited

U.S. PATENT DOCUMENTS 3,550,532 A * 12/1970 Zimmerman et al. ..... 102/465
3,946,951 A * 3/1976 Danforth ..... 241/21
4,955,723 A * 9/1990 Schneider ..... 366/136
5,211,475 A * 5/1993 MdDermott et al. ..... 366/137
5,511,876 A * 4/1996 Plessers et al. ..... 366/153.1
5,580,168 A * 12/1996 Alireza et al. ..... 366/153.1
5,785,817 A * 7/1998 Tan et al. ..... 162/218
5,817,216 A * 10/1998 Tomita et al. ..... 162/389
5,951,161 A * 9/1999 Blagg ..... 366/152.6
6,592,246 B2 * 7/2003 Maree ..... 366/132
2001/0040016 A1 * 11/2001 Kumamoto et al. ..... 162/218
2003/0010462 A1 * 1/2003 Nonomura et al. ..... 162/218
2003/0015610 A1 * 1/2003 Mannes et al. ..... 241/21

FOREIGN PATENT DOCUMENTS

JP 2-91294 3/1990 ..... D21F/13/00
JP 3-76780 4/1991 ..... C09K/3/14
JP 3-107628 5/1991 ..... F16D/69/00
JP 11-241290 9/1999 ..... D21F/13/00
JP 2000-063802 A 2/2000

OTHER PUBLICATIONS

Tappi Test Method 2 05 om–81, "Forming Handsheets for Physical test of Pulp," pp–6, Jan. 1981.*
James E. Kline, "Paper and Paperboard Manufacturing Fundamentals," 1991, Miller Freeman Publications, Inc., Second edition, pp. 15–17.*
OMAF Staff, "Application Technology: Materials, Mixing and Mixtures" Nov. 25, 2002, pp. 1–3*
JPO Machine translation of JP Publication No. 200–063802, Published on Feb. 29, 2000.*

* cited by examiner

*Primary Examiner*—José A. Fortuna
(74) *Attorney, Agent, or Firm*—Sughrue Mion, PLLC

(57) ABSTRACT

An apparatus for making paper includes a stirring tank and a paper making portion. The stirring tank includes: an outer cylinder; a middle cylinder disposed concentrically with the outer cylinder; a raw-material feeding port for feeding raw-material into said stirring tank; a stirring mechanisms; and a top plate for holding the outer and middle cylinders in a predetermined position. The paper making portion is installed below the stirring tank and includes: a wire cloth and a paper making frame having an opening for holding said wire cloth, and the opening is connected to a suction unit. The stirring mechanisms are uniformly disposed above the wire cloth. In addition, a plurality of raw-material feeding ports are uniformly disposed above the wire cloth.

2 Claims, 11 Drawing Sheets

PAPER MAKING METHOD AND APPARATUS

BACKGROUND OF THE INVENTION

1. Field of the Invention

The present invention relates to a method and apparatus for making paper from a solution including various kinds of fiber base materials and fillers dispersed in water, and more particularly to a method and apparatus for making raw paper as an intermediate of a wet friction material for use as a friction plate.

2. Description of the Related Art

Conventionally, annular frictional materials for use as frictional plates and the like have been made by punching from sheets of paper before or after the paper are thermoset while impregnating with thermosetting resin. However, since the yield of the raw material under this method is low, there have recently been developed new methods of directly making such annular frictional plates out of raw paper (e.g., JP-A-2-91294, JP-A-3-76780, JP-A-3-107628, etc.).

On the other hand, in the case of obtaining discontinuous paper bodies such as handmade paper, there still exists a problem of bad formation, and JP-A-11-241290 discloses a method of improving the formation.

According to the conventional methods and apparatus for manufacturing discontinuous paper bodies such as annular bodies, the paper formation has not necessarily been satisfactory.

SUMMARY OF THE INVENTION

An object of the present invention is to provide a paper making method and apparatus for obtaining discontinuous paper bodies with further good paper formation.

In order to solve the foregoing problem, according to the present invention, there is provided a method of making a discontinuous paper body, including the steps of: feeding a raw material with a predetermined concentration into water which is in a stirred condition; maintaining the stirring condition for a predetermined time after the feeding step is completed; and passing the raw material diluted with the water through a wire cloth, while the stirred condition is maintained. Further, there is provided an apparatus for making paper, including: a stirring tank including: an outer cylinder; a middle cylinder disposed concentrically with said outer cylinder; a raw-material feeding port for feeding raw-material into said stirring tank; stirring mechanisms; and a top plate for holding said outer and middle cylinders in a predetermined position, and a paper making portion installed below the stirring tank, said paper making portion including: a wire cloth; and a paper making frame having an opening for holding the wire cloth, the opening being connected to a suction unit, wherein the stirring mechanisms are uniformly disposed above the wire cloth.

In addition, there is provided a paper making method wherein raw material is supplied from a raw-material feeding port disposed above a wire cloth uniformly onto the wire cloth. Further, there is provided a paper making apparatus includes a stirring tank including an outer cylinder, raw-material feeding ports for supplying raw material, stirring mechanisms, and a top for holding these members in position, wherein a paper making portion which is disposed in the lower portion of the stirring tank, has a central body having an opening for holding wire cloth and is connected to a suction unit, wherein said raw-material feeding ports are uniformly disposed above the wire cloth or the raw material is supplied from the raw-material feeding ports alternately disposed with respect to the central annular line of the paper making portion of wire cloth or each raw-material feeding port is directed toward the outer peripheral face of the middle cylinder or each raw-material feeding port is directed toward the upper apex of the conical surface.

DETAILED DESCRIPTION OF THE PREFERRED EMBODIMENTS

A paper making apparatus according to a first aspect of the invention is structured that an outer cylinder, a middle cylinder, stirring air nozzles, a cleaning fluid jet mechanism and a raw-material feeding port are secured to a top plate. The air nozzles are uniformly arranged above the central annular line of a paper making portion of a wire cloth or alternately arranged with respect to the central annular lines thereof. The paper formation is improved on a condition that the air nozzles are uniformly arranged without being biased to the upper portion of the paper making portion of the wire cloth. Consequently, it is also preferable to uniformly arrange the directions of openings for jetting air without being biased in one direction.

The middle cylinder is formed in a substantially conical shape and the raw-material feeding port is provided above the apex of the substantially conical portion, so that the thickness of a paper body can be uniformed.

Further, a water jet is used as the cleaning fluid jet mechanism. A jet of water from the water jet may be performed in the form of a mist, waterdrops or a line of water, but it is preferable that a plurality of water jets are provided so that the fluid can equally be sprayed on the whole inside of a stirring tank.

In addition, a paper making apparatus according to a second aspect of the invention is structured that an outer cylinder, a middle cylinder, stirring air nozzles, a cleaning fluid jet mechanism, raw-material feeding ports and the like are secured to a top. The raw-material feeding ports are uniformly arranged above the central annular line of a paper making portion of a wire cloth or alternately arranged with respect to the central annular lines thereof. Moreover, the raw-material feeding ports are directed to the outer peripheral surface of the inner cylinder. Otherwise, the central body of a paper making frame is formed in a conical shape, whereby to construct the raw-material feeding ports above the apex. By feeding the raw material from the raw-material feeding ports, the concentration of the raw material before the operation of making paper is uniformed without imbalance.

The paper making portion of the wire cloth means an exposed portion between the outer cylinder and the central body, that is, a portion where the paper body is remained on the wire cloth after the paper making operation. Further, the central body is structured to form a central hole of an annular paper body.

The raw-material feeding ports are only needed for allowing the raw material to be fed and the diameter of each jet hole is set to be large enough to prevent the raw material from being clogged.

[First Embodiment]

Figure 1:
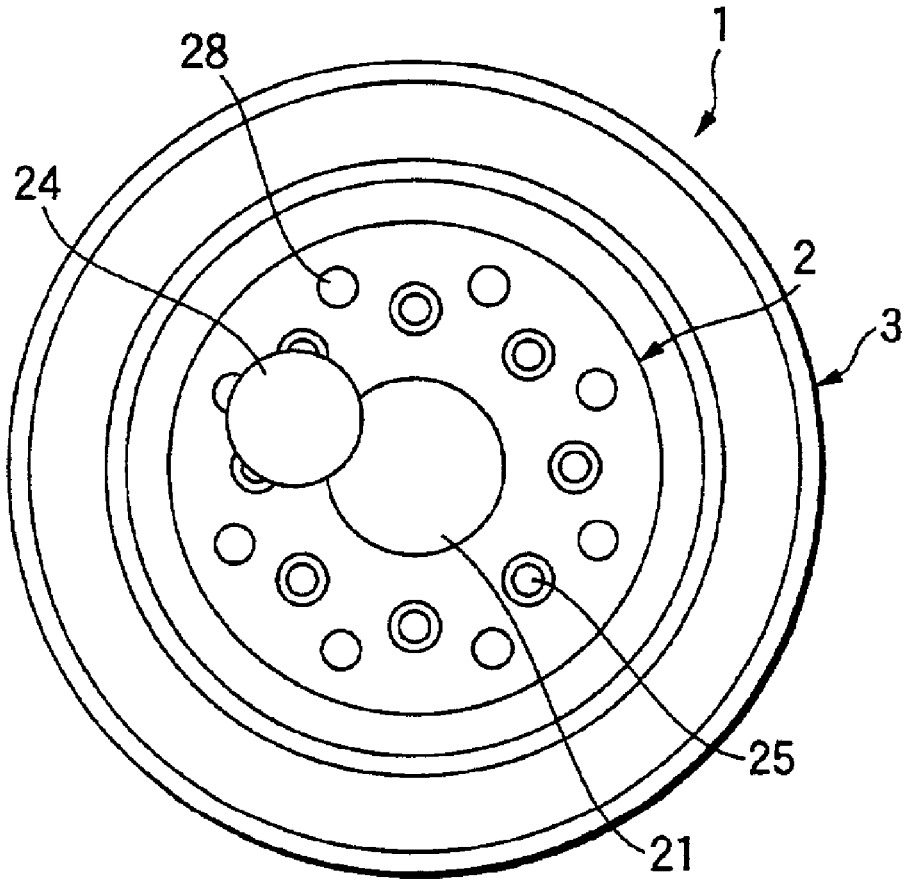
FIG. 1 is a top view of a paper making apparatus according to a first embodiment of the present invention.
Figure 2:
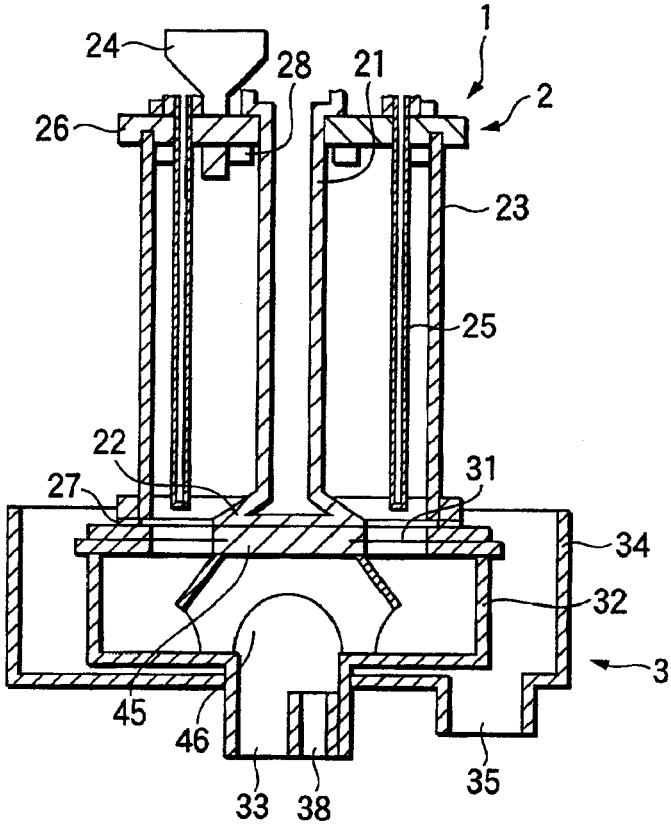
FIG. 2 is a sectional view of FIG. 1.
Figure 3:
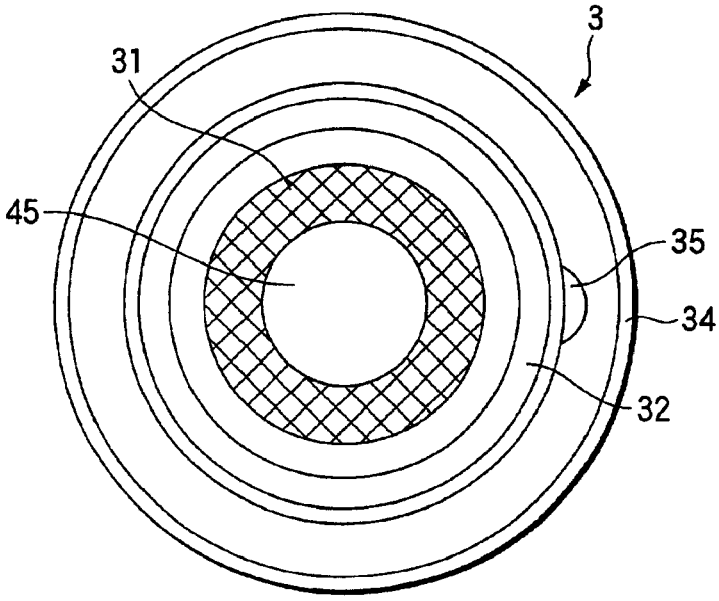
FIG. 3 is a top view of a paper making portion according to the first embodiment.

With reference to FIGS. 1 to 6, a description will be given of a paper making apparatus according to a first embodiment of the invention. As shown in FIGS. 1 to 3, a paper making apparatus 1 includes a stirring tank 2 and a paper making portion 3. The stirring tank 2 includes a middle cylinder 21, an outer cylinder 23 concentric with the middle cylinder 21, a raw-material feeding port 24, air nozzles 25 as stirring mechanisms and jet holes 28, which are respectively secured to an aluminum top plate 26. The middle cylinder 21 has a substantially conical portion 22 in the lower end portion thereof. The jet holes 28 jet water for cleansing the middle cylinder 21 and the outer cylinder 23. A seal ring 27 is also secured to the lower end portion of the outer cylinder 23.

The paper making portion 3 is structured such that a wire cloth 31 is fitted to the top of a paper making frame 32 and a cover 34 for collecting moisture component such as the overflowed raw material is located in the outside of the paper making frame 32. Reference numeral 38 denotes a water supply port; 33, a moisture suction port; 35, a discharge port of the cover 35; 45, a central body; and 46, an opening. FIG. 3 is a top view of the paper making portion 3.

The apparatus shown in the drawings is designed to form an annular paper body as a discontinuous paper body, and the central body 45 forms a central hole.

Figure 4:
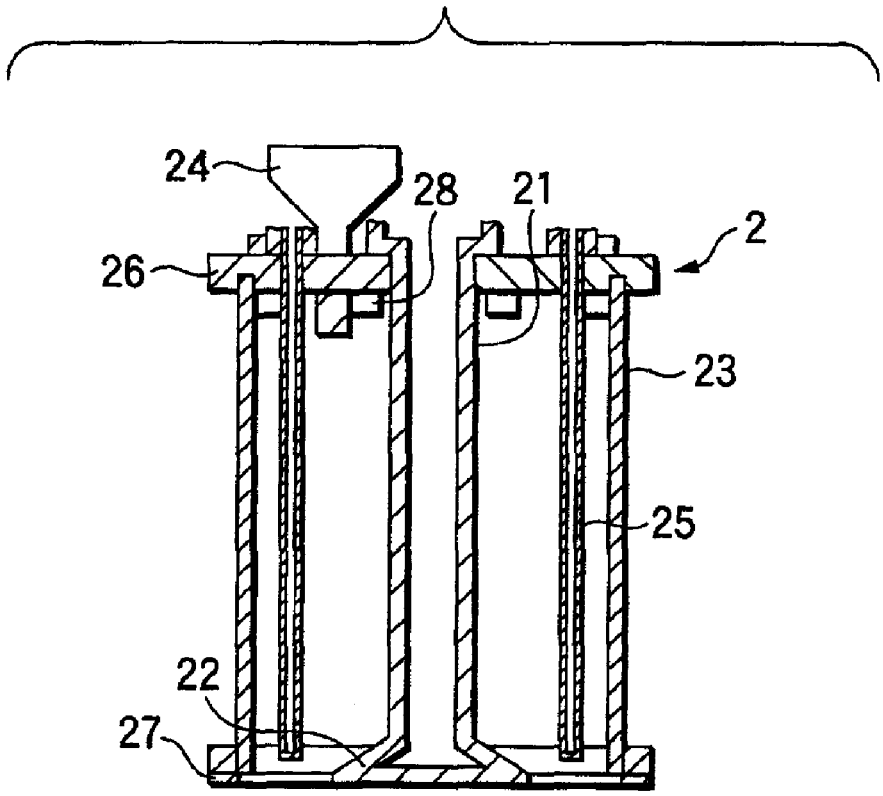
FIG. 4 is a view showing a separate condition of a stirring tank and the paper making portion according to the first embodiment.
Figure 4:
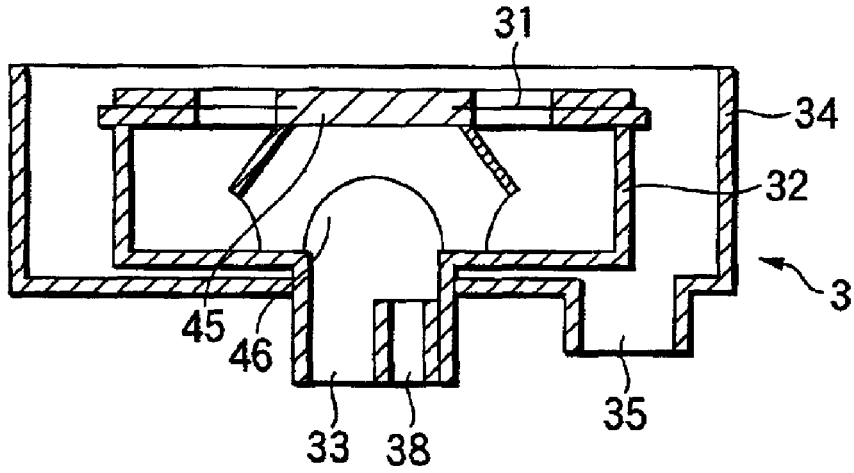
Figure 5:
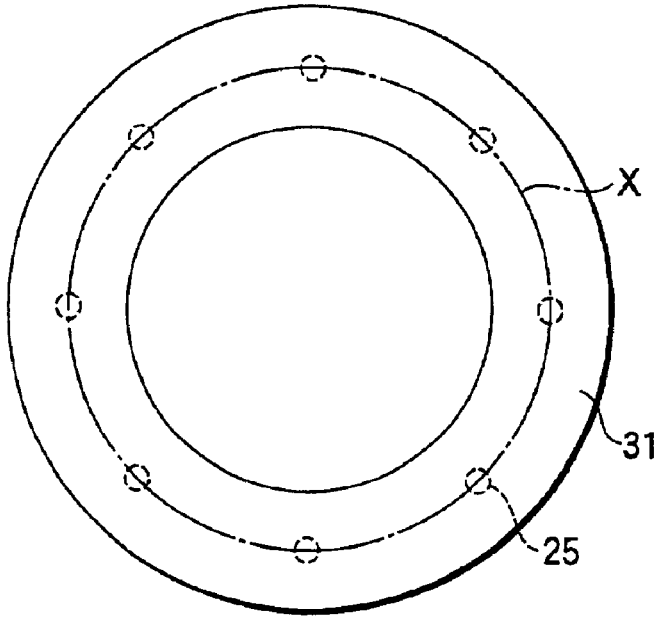
FIG. 5 is a top view of an arrangement of stirring mechanisms according to the first embodiment.
Figure 6:
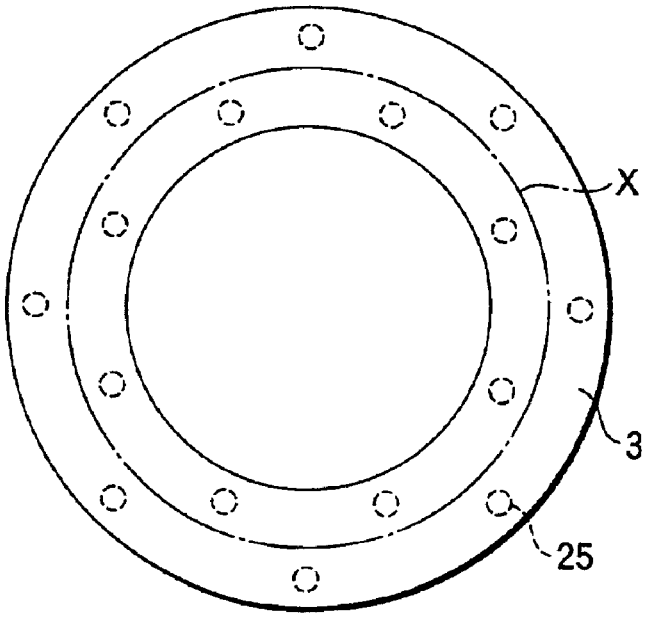
FIG. 6 is a top view of another arrangement of stirring mechanisms according to the first embodiment.

FIG. 4 shows a condition that the stirring tank 2 and the paper making portion 3 in the apparatus shown in FIGS. 1 and 2 are separated from each other. FIGS. 5 and 6 are top views showing an arrangement of air nozzles 25 as stirring mechanisms.

As shown in FIG. 4, the stirring tank 2 is separated from the paper making portion 3 and cleansed in another place where smudges adhered to the inner wall of the outer cylinder 23 and the outer wall of the middle cylinder 21.

In FIGS. 5 and 6, a line X represents a central annular line of the paper making portion of the wire cloth 31. In FIG. 5, the air nozzles 25 are uniformly disposed along the central annular line X, whereas in FIG. 6, the air nozzles 25 are alternately disposed with respect to the central annular line X. With these arrangements, the raw material within the stirring tank 2 is evenly stirred, whereby the formation of the paper body is improved.

A description will now be given of a method of making paper using the apparatus according the first embodiment. First, the stirring tank 2 and the paper making portion 3 are combined together as shown in FIG. 2. When a predetermined amount of water is supplied via the water supply port 38, the water is passed through an opening 46 to thereby be gathered inside the paper making frame 32 and between the middle cylinder 21 and the outer cylinder 23. Further, the air is jetted out via the air nozzles 25 so as to stir the water gathered between the middle cylinder 21 and the outer cylinder 23. In this condition, the raw material diluted to a predetermined concentration is fed from the raw-material feeding port 24. While the stirred condition is kept even after the raw material has been fed for several ten seconds, the paper making is carried out. Then, moisture component (including moisture component contained in the raw material) is sucked from a suction port 33 and discharged. Thus, a paper body is made on the wire cloth 31.

[Second Embodiment]

Figure 7:
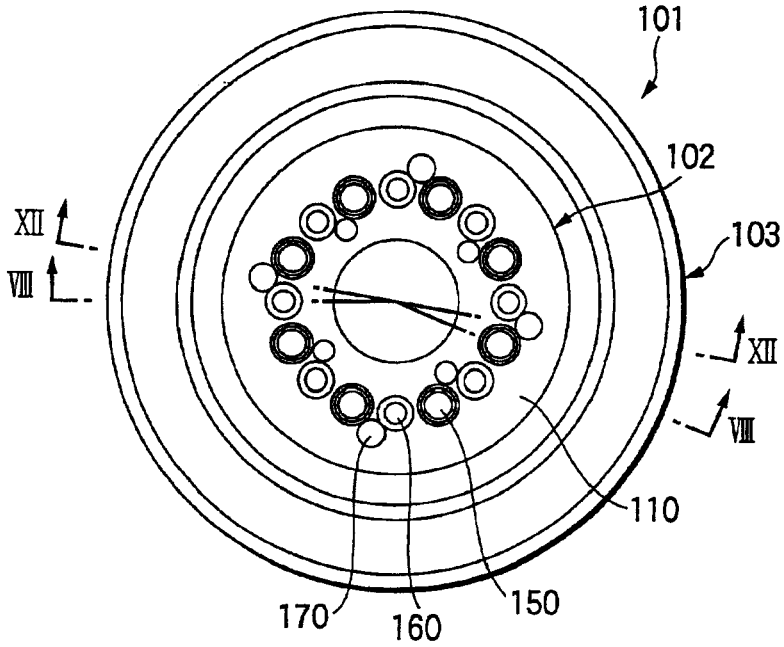
FIG. 7 is a top view of a paper making apparatus according to a second embodiment of the present invention.
Figure 8:
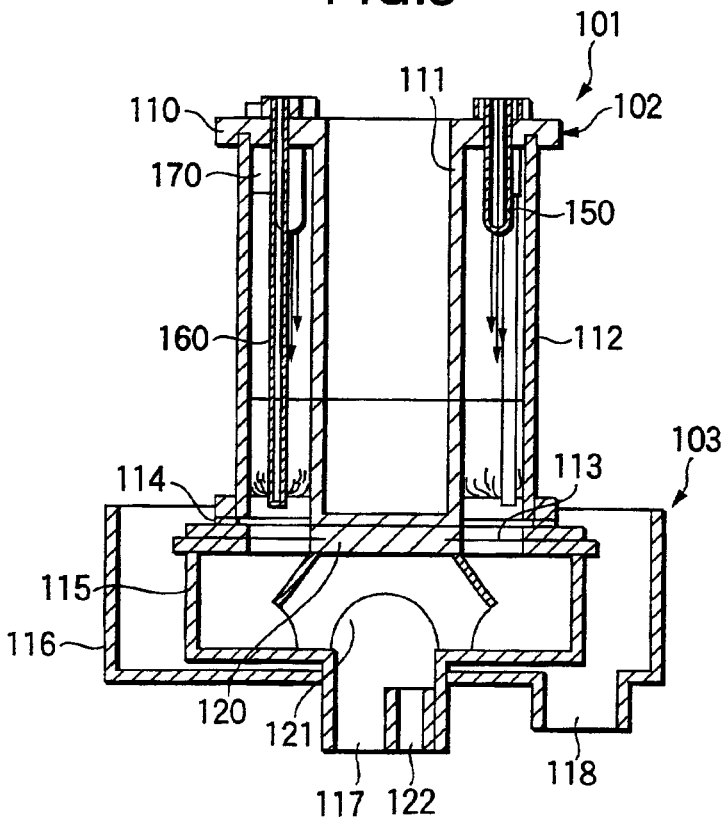
FIG. 8 is a sectional view taken along the line VIII—VIII of FIG. 7.
Figure 9:
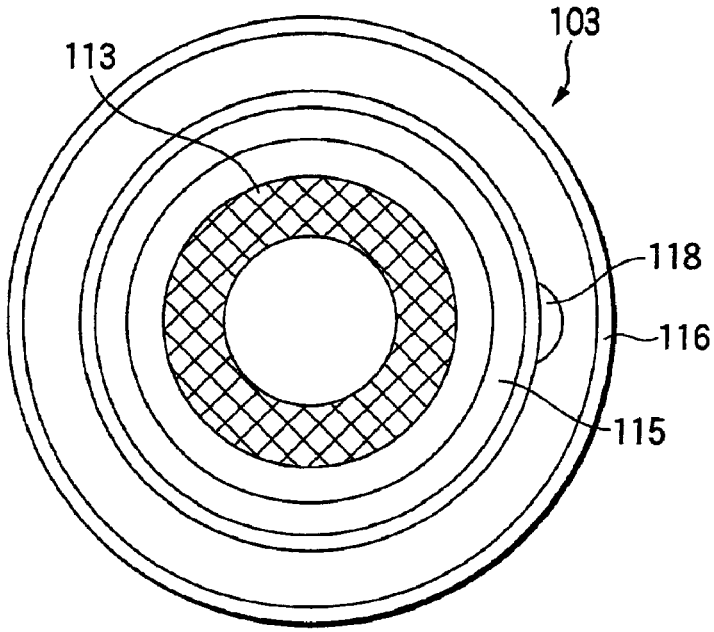
FIG. 9 is a top view of a paper making portion according to the second embodiment.

A description will be given of a paper making apparatus according to a second embodiment of the invention with reference to FIGS. 7 to 12. As shown in FIGS. 7 to 9, a paper making apparatus 101 includes a stirring tank 102 and a paper making portion 103. The stirring tank 102 is formed by mounting raw-material feeding ports 150, stirring air nozzles 160, jet nozzles 170 and an outer cylinder 112 onto an aluminum top 110 integrally formed with a middle cylinder 111. A seal 114 is secured to the lower portion of the outer cylinder so as not to leak the raw material outside.

On the other hand, the paper making portion 103 includes a paper making frame 115, a cover 116 and a central body 120. The paper making frame 115 holds a wire cloth 113 and has a suction port 117. The cover 116 collects moisture component such as the raw material caused to overflow outside from the paper making frame 115. The central body 120 has an opening 121 communicating with the suction port 117. Reference numeral 118 denotes a discharge port of the cover 116.

As shown in FIG. 7, the raw-material feeding ports 150 and the air nozzles 160 are arranged equally on the annular wire cloth. With this arrangement, the raw material can equally be fed within the stirring tank and the concentration of the raw material within the stirring tank can also be equalized immediately before the operation of making paper is performed.

Figure 10:
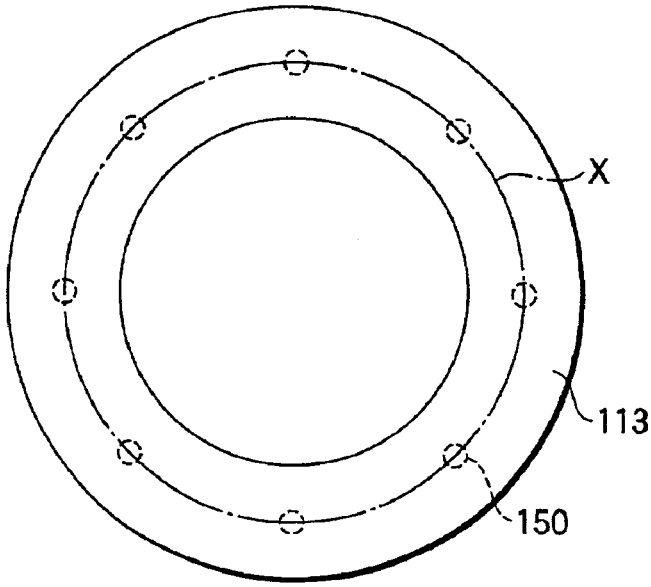
FIG. 10 is a view showing an arrangement of raw-material feeding ports according to the second embodiment.
Figure 11:
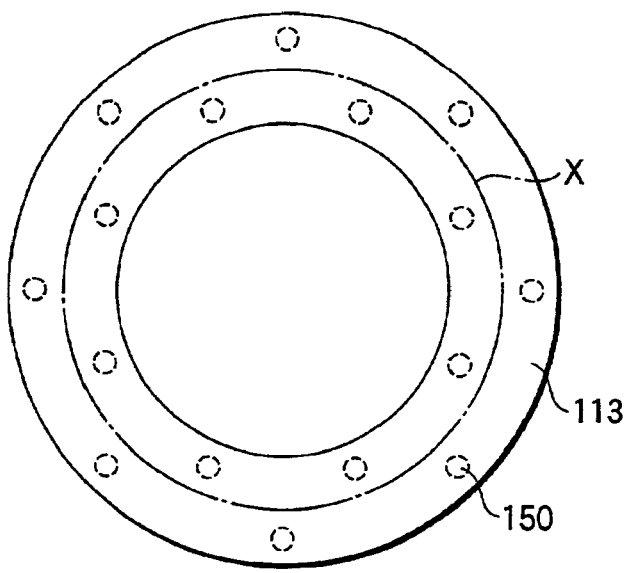
FIG. 11 is a view showing another arrangement of raw-material feeding ports according to the second embodiment.

FIGS. 10 and 11 are views showing an arrangement of the raw-material feeding ports when viewed the paper making portion of the wire cloth 113 from the above; FIG. 10 illustrates as shown in FIGS. 7 and 8 the raw-material feeding ports that are equally arranged on the central annual line X of the paper making portion of the wire cloth 113; and FIG. 11 illustrates the raw-material feeding ports that are alternately arranged with respect to the central annular line X.

Figure 12:
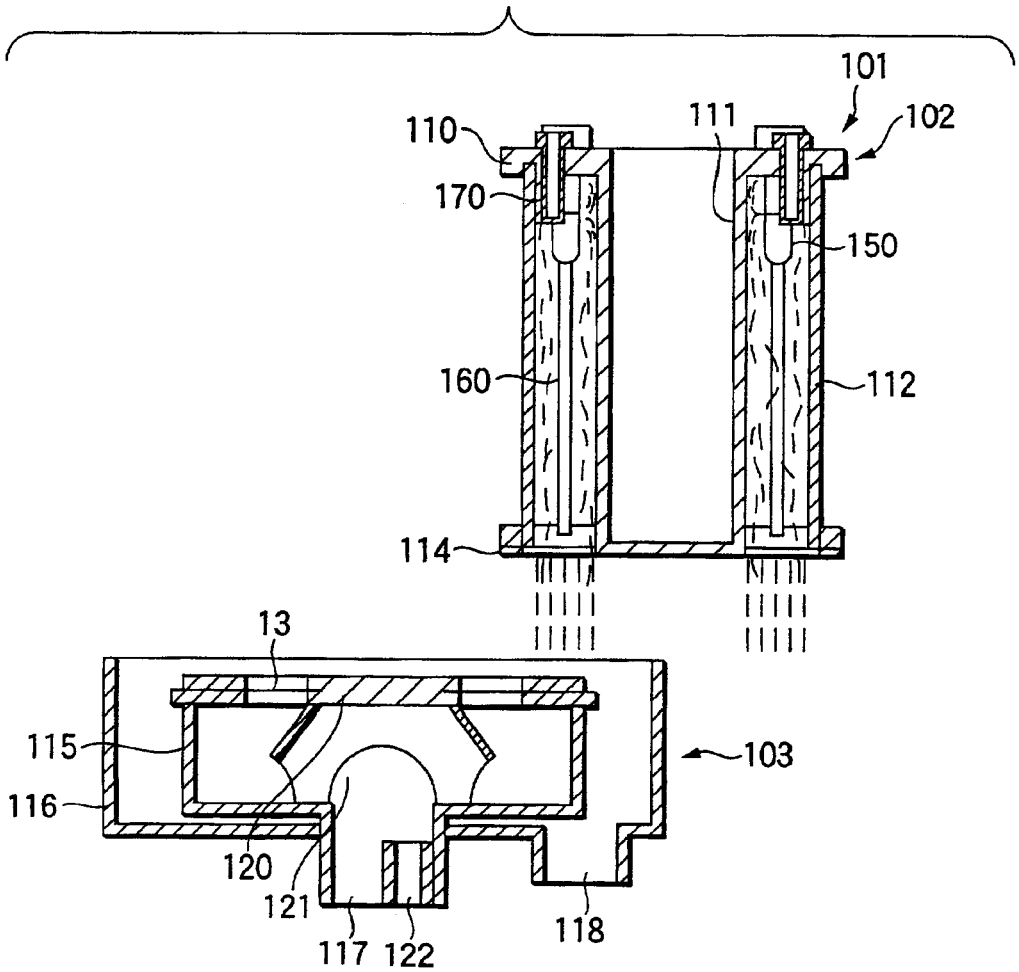
FIG. 12 is a sectional view taken along the line XII—XII of FIG. 7 and showing a paper making apparatus that is separated.

A description will now be given of a method of making paper using the apparatus according to the second embodiment of the invention. First, the stirring tank 102 and the paper making portion 103 are combined together as shown in FIG. 8. (FIG. 12 shows a separated condition. Incidentally, although FIG. 8 shows the sectional view taken along the line VIII—VIII of FIG. 7, FIG. 12 shows a sectional view taken along the line XII—XII of FIG. 7). When a predetermined amount of water is supplied via a water supply port 122 to be gathered inside the paper making frame 115 and between the middle cylinder 111 and the outer cylinder 112. Further, air is jetted via the air nozzles 160 so as to stir the water gathered between the middle cylinder 111 and the outer cylinder 112.

In this condition, the raw material diluted to a predetermined concentration is fed from the raw-material feeding ports 150. The stirred condition is kept even after the raw material has been fed for 30 seconds, and then, the paper making is carried out. Moisture component (including moisture component containing the raw material) is sucked from a suction port 117 and discharged. Thus, a paper body is made on the wire cloth 113. The operation of making paper may be performed while the stirred condition is maintained or after the stirred condition is stopped.

FIG. 12 shows a condition that the stirring tank 102 and the paper making portion 103 in the paper making apparatus 111 are separated and further the stirring tank 102 is cleansed. The cleansing is carried out by jetting the water in the stirring tank 102 via the air nozzles 170. The air nozzle 170 is installed in a plurality of places and the cleansing is carried out as a separate step separately from the paper making portion 103.

[Third Embodiment]

Figure 13:
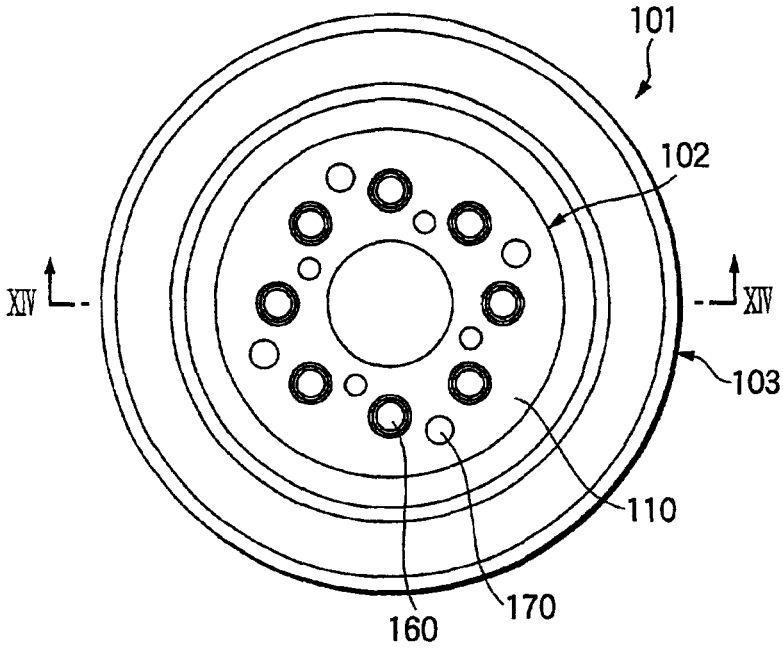
FIG. 13 is a top view of a paper making apparatus according to a third embodiment of the invention.
Figure 14:
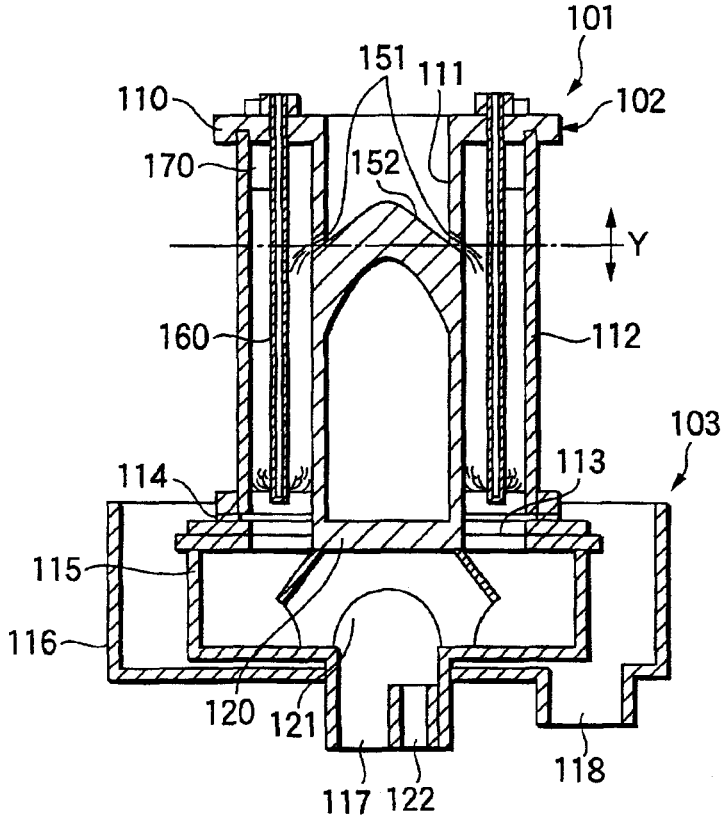
FIG. 14 is a sectional view taken along the line XIV—XIV of FIG. 13.

A description will be given of a paper making apparatus according to a third embodiment of the invention with reference to FIGS. 13 and 14. The third embodiment is different from the second one in that raw-material feeding ports 151 are provided on the sides of the middle cylinder 111. The basic structure of the third embodiment is similar to what is shown in FIGS. 13 and 14, and the constitutional elements identical with those of the second embodiment are given by like reference numerals. In the second embodiment of the invention shown in FIGS. 13 and 14, as the raw-material feeding ports 150, the air nozzles 160 and the jet water nozzles 170 are fitted to the top plate 110, the space of the top is narrowed. In case where the diameter of the paper body to be made is large, there develops no problem, but in case where the diameter thereof is small, however, the installation area of such a top plate would cause a serious problem.

The apparatus structured according to the third embodiment of the invention can solve any problem of the sort mentioned above. Further, since the number of raw-material feeding ports 151 and air nozzles 160 can be increased, the concentration of raw material is uniformed further. Incidentally, the positions of the raw-material feeding ports may be above or below the water level Y in the stirring tank 102.

Further, an inclination 152 directed upward from each raw-material feeding port 151 is formed such that no raw material is left on the bottom surface of the middle cylinder 111. In addition, the raw-material feeding port 151 is also inclined so as to match with the inclination 152.

[Fourth Embodiment]

Figure 15:
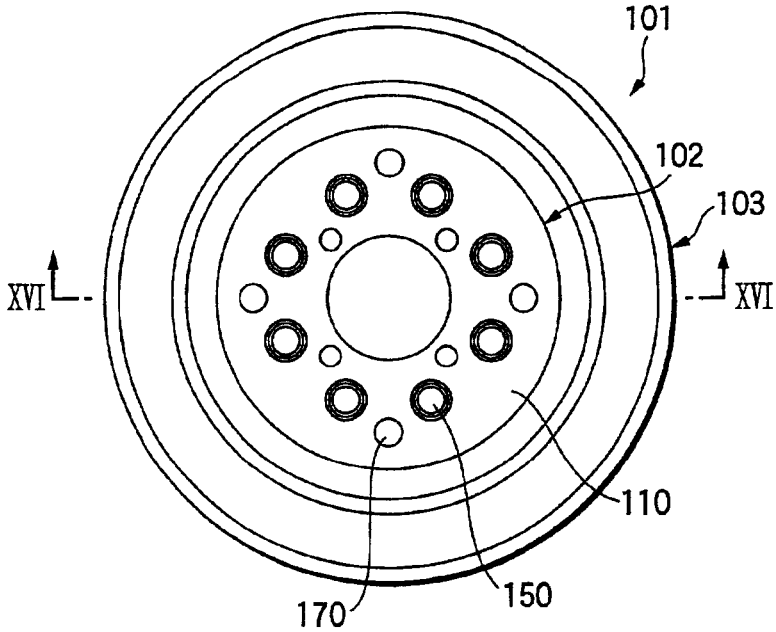
FIG. 15 is a top view of a paper making apparatus according to a fourth embodiment of the invention.
Figure 16:
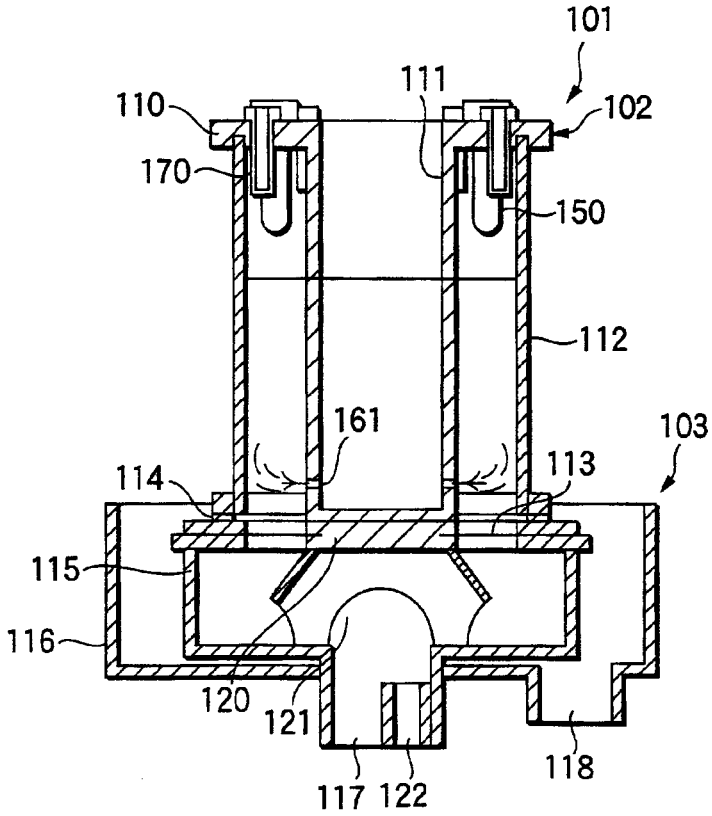
FIG. 16 is a sectional view taken along the line XVI—XVI of FIG. 15.

A description will be given of a paper making apparatus according to a fourth embodiment of the invention with reference to FIGS. 15 and 16. The constitutional elements identical with those of FIGS. 7 and 9 are given by like reference numerals. The fourth embodiment is different from the first and second embodiments in that the stirring air nozzles are not fitted to the top plate, but air is jetted from air jet holes 161 defined to the middle cylinder 111. The rest of the formation of this embodiment of the invention is similar to what is shown in the second embodiment thereof.

Although not shown, the stirring tank may be cleansed by jetting the water from the holes bored in the middle cylinder.

[Fifth Embodiment]

Figure 17:
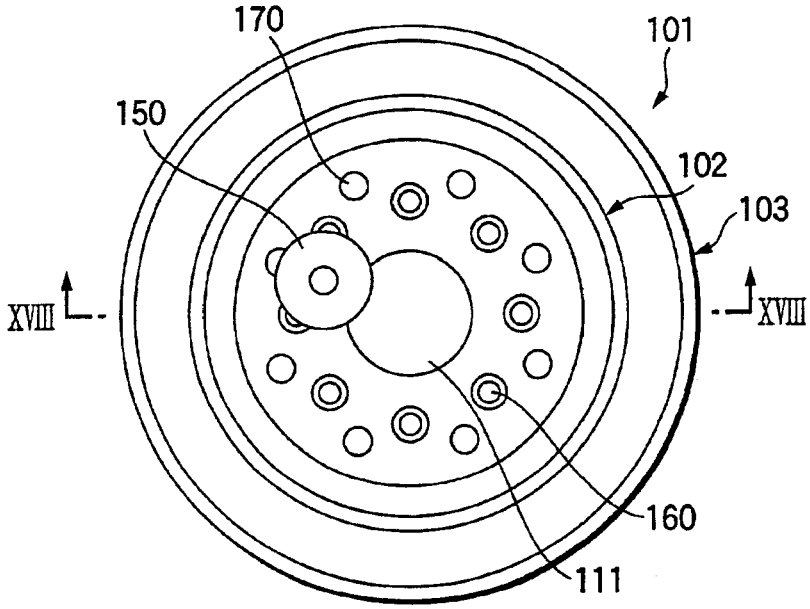
FIG. 17 is a top view of a paper making apparatus according to a fourth embodiment of the invention.
Figure 18:
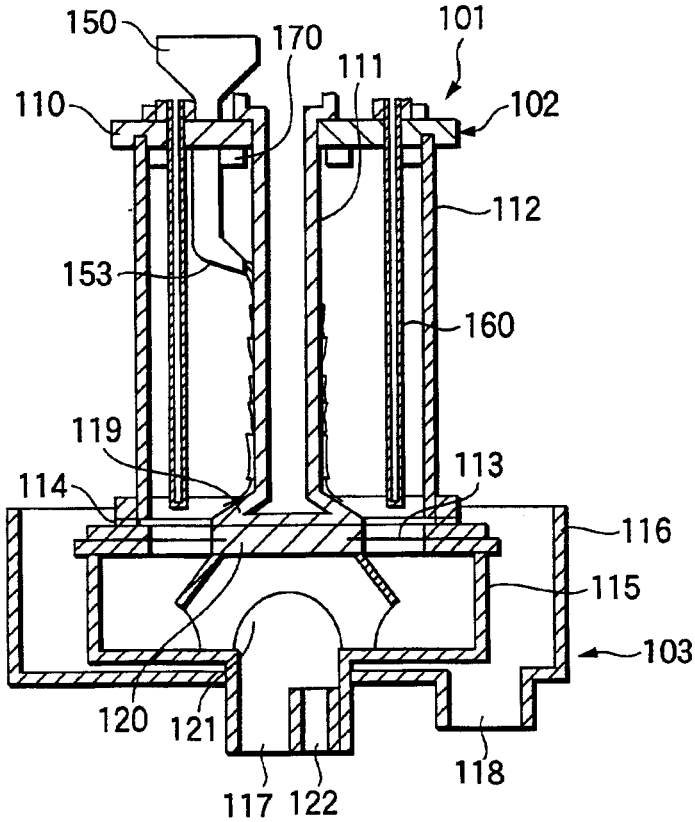
FIG. 18 is a sectional view taken on line XVIII—XVIII of FIG. 17.

A description will be given of a paper making apparatus according to a fifth embodiment of the invention with reference to FIGS. 17 and 18. In this embodiment, the front end 153 of each raw-material feeding port 150 is directed to the outer peripheral face of the middle cylinder 111 and the fed raw material is flown along the outer peripheral face of the middle cylinder 111. Further, the lower end of the middle cylinder 111 is formed in a conical surface 119 and with this arrangement, even though only one raw-material feeding port is provided, the raw material moves down on the outer peripheral face of the middle cylinder 111 and together with the conical surface at its lower end, the raw material is uniformly supplied onto the wire cloth 113.

[Sixth Embodiment]

Figure 19:
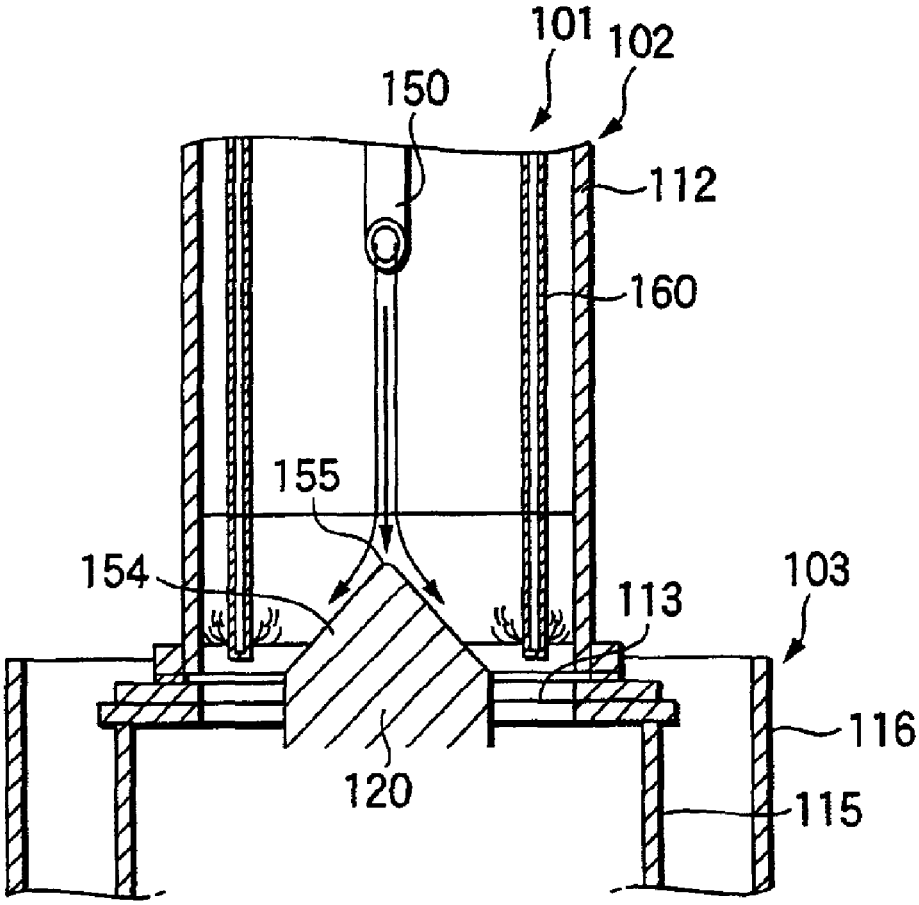
FIG. 19 is a sectional view of a paper making apparatus according to a sixth embodiment of the invention.

A description will be given of a paper making apparatus according to a sixth embodiment of the invention with reference to FIG. 19. In this embodiment, the surface of the central body 120 is formed in a substantially conical shape, and the raw-material feeding port 150 is disposed above the apex of the cone.

With this arrangement, the raw material is caused to flow in the whole peripheral direction along the conical surface 154, so that the raw material is uniformly supplied onto the wire cloth 113.

According to the present invention, the paper making method and apparatus are thus arranged, it is possible to obtain the discontinuous paper body with an excellent paper formation.

While only certain embodiments of the invention have been specifically described herein, it will apparent that numerous modifications may be made thereto without departing from the spirit and scope of the invention.

What is claimed is:

1. A method of making a discontinuous paper body, comprising:

feeding a raw material with a predetermined concentration into water which is in a stirred condition;

maintaining the stirred condition for a predetermined time after said feeding step is completed; and passing the raw material diluted with the water through a wire cloth, while the stirred condition is maintained;

wherein said paper body is a discontinuous annular body, and the stirred condition is obtained by a plurality of stirring mechanisms equally disposed above said wire cloth.

2. The paper making method according to claim 1, wherein said stirring mechanisms are air nozzles, and the raw material is stirred by air jetted from said air nozzles.

* * * * *